US008746694B2

(12) United States Patent
Moore et al.

(10) Patent No.: US 8,746,694 B2
(45) Date of Patent: Jun. 10, 2014

(54) IN-LINE SUBSTRATE MEDIA SENSOR AND PROTECTIVE GUIDE

(71) Applicant: Xerox Corporation, Norwalk, CT (US)

(72) Inventors: Steven R. Moore, Pittsford, NY (US); Peter Knausdorf, Henrietta, NY (US); Michael D. Borton, Ontario, NY (US); Joannes N. M. deJong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/646,049

(22) Filed: Oct. 5, 2012

(65) Prior Publication Data

US 2014/0098153 A1 Apr. 10, 2014

(51) Int. Cl.
*B65H 7/12* (2006.01)
*B41J 11/20* (2006.01)

(52) U.S. Cl.
USPC ..... 271/262; 400/55

(58) Field of Classification Search
USPC ..... 347/4–5, 16–17, 102, 103, 104; 271/262, 265.04, 282, 283; 400/55, 56, 400/58, 59; 399/406
See application file for complete search history.

(56) References Cited

U.S. PATENT DOCUMENTS

| | | | | | |
|---|---|---|---|---|---|
| 5,004,218 | A * | 4/1991 | Sardano et al. | ..... | 271/35 |
| 5,156,464 | A * | 10/1992 | Sakai | ..... | 400/56 |
| 5,468,076 | A * | 11/1995 | Hirano et al. | ..... | 400/59 |
| 6,022,015 | A * | 2/2000 | Matsumoto | ..... | 271/121 |
| 6,259,888 | B1 * | 7/2001 | Kazama et al. | ..... | 399/406 |
| 6,666,537 | B1 | 12/2003 | Kelley et al. | | |
| 6,908,189 | B2 * | 6/2005 | Miyamoto et al. | ..... | 347/102 |
| 2004/0233244 | A1 | 11/2004 | Elgee et al. | | |
| 2011/0279507 | A1 | 11/2011 | Castillo et al. | | |

* cited by examiner

*Primary Examiner* — Anh T. N. Vo
(74) *Attorney, Agent, or Firm* — Hoffmann & Baron, LLP

(57) ABSTRACT

A sensing method and system to protect printer print heads from substrate media contact comprising a trip wire sensor to detect and signal a printer control system that substrate media carried by transport media is positioned to strike or contact the print head. The trip wire sensor is located upstream of the print heads, a controlled distance above the transport media in the direction normal to the plane of the media, and comprises a trip wire operatively connected to at least one transducer. Substrate media exceeding the height requirements associated with the print heads contact the trip wire sensor causing the generation of an electrical signal which is received by the printer control system which then takes corrective action to prevent damage to the print heads, for example, by raising the print heads further away from the transport media and allowing the non-conforming substrate media to pass through and be purged. Also disclosed is a protective guide positioned to constrain substrate media from going over the top of the trip wire which can result in the substrate media becoming jammed in the trip wire sensor.

23 Claims, 9 Drawing Sheets

IN-LINE SUBSTRATE MEDIA SENSOR AND PROTECTIVE GUIDE

BACKGROUND

1. Field of the Disclosure

The present disclosure relates to methods of document creation. More specifically, the present disclosure is directed to an apparatus and method for printing in which the printer's print heads are protected from substrate media contact.

2. Brief Discussion of Related Art

In certain printers using ink jet direct marking technology, it is expected that marking inks, e.g., solid inks, UV gel inks, aqueous inks and others, will be jetted directly onto cut sheet substrate media. A critical parameter in this printing process is the size of the print head to media gap. In certain current technology, the gap is set as small as 0.5 mm in order to minimize the pixel placement errors due to misdirected jets. For other print heads, for example those having high drop velocity, it is possible that the gap can be opened to 0.75-1.0 mm. Nevertheless, these tight print head to media gaps pose a challenge for any cut sheet media substrate media printer, since the sheet lead edge (LE) and trail edge (TE), and to a lesser extent the sheet body are generally not perfectly flat.

For accurate pixel placement and color registration, it is desired to keep the print head to substrate media gap within a +/−0.1 mm range about the nominal. To avoid print head front face damage, the substrate media should not be allowed to "close the gap", i.e., to contact the print head(s). Both vacuum escort belt and/or electrostatic tack escort belt technology are technologies which may be employed to hold cut sheets of substrate media sufficiently flat. However, neither technology is completely robust against LE and TE upcurl defects.

One method of addressing the problem of upcurl defects is to provide the cut sheet printer with a pre-curler subsystem which biases sheets into a flat or down-curl configuration. However, certain initial sheet substrate media non-uniform conditions, such as corner curl, edge wave, and cockle, can be difficult to detect and fully compensate for within the pre-curler. Hence, sheets may not be held sufficiently flat in the print zone, to the extent that the print head(s) may be damaged.

SUMMARY

The present disclosures are directed to printers having a first media transport operative to receive a substrate media, to convey the substrate media towards, into, through, out of or away from print head(s) in the marking zone, and methods and apparatus to detect and take corrective action to avoid non-conforming substrate from damaging the prints head(s).

A sensing method and system is disclosed comprising a trip wire sensor to detect and signal a printer control system that non-conforming substrate media carried by the transport media is positioned to strike or contact the print heads. The trip wire sensor is located upstream of the print heads, a controlled distance above the transport media in the direction normal to the plane of the media, and comprises a trip wire operatively connected to at least one transducer. Trip wire height adjusters may be provided to raise and lower the sensor as a function of expected media thickness. Substrate media exceeding the height requirements associated with the print heads contact the trip wire sensor causing the generation of an electrical signal which is received by the printer control system which then takes corrective action to prevent damage to the print heads, for example, by raising the print heads further away from the transport media and allowing the non-conforming substrate media to pass through and be purged. A sufficiently sized reaction zone is provided between the trip wire sensor and the print heads to afford the printer control system enough time to effectuate corrective action as the non-conforming substrate media moves from the trip wire sensor toward the print heads.

Also disclosed is a protective guide positioned to constrain substrate media from going over the top of the trip wire which can result in the substrate media becoming jammed in the trip wire sensor. Embodiments of the protective guide provide that its lower surface is positioned flush or slightly above the bottom of the trip wire. The protective guide or constraining baffle gives stiffness to the substrate media sheet which is also constrained by the height of the protective guide to contact the underside of the trip wire, all to avoid jamming.

The marking zone is an area associated with the printer in which the substrate media is marked with an image. Generally, though not exclusively, the first media transport comprises a belt routed over a plurality of rollers, the belt being moved and moveable under the influence of a motive force applied to at least one roller among the plurality of rollers.

A hold-down system of the printer and/or first media transport, optionally a vacuum powered hold-down system, an electrostatic hold-down system, or a combination of the two, generates a hold-down pressure applied to the substrate media in the direction of the first media transport. A pre-curler unit is operative to apply a predetermined degree of curl to the substrate media. A trip wire sensor signals the control system if the substrate media height above the first media transport exceeds a predetermined height. Generally, the predetermined height is such that the substrate media will not touch the print head(s) or otherwise approach the print head(s) too closely. If the trip wire sensor signals the printer control system that the substrate media has hit it, the printer control system in turn can take corrective action to prevent print head damage. The corrective action could comprise the printer control system signaling for the stopping or slowing the media transport while increasing the gap between the media transport and the print head(s) and allowing the non-conforming sheet substrate media to pass through without touching the print head(s) and, if necessary, be purged. The corrective action could also comprise the printer control system signaling for the stopping and reversing the travel direction of the first media transport in order to re-route the hitting substrate media back to an upstream purge or other location.

A print head array, comprising at least one print head, marks the substrate media with an image in the marking zone, and an actuator adjusts the relative spacing between the print head array and the first media transport. The actuator may include at least one of a linear and rotary actuator, powered by at least one of a fluid or electric motive power, and be configured to move at least one or both of the print head array and the first media transport to alter the distance between the two.

The actuator is operative to set the gap between the media transport and the print head array at a first relative spacing at which marking of the substrate media may selectively occur, based in part on the expected substrate media thickness and hence height above the first media transport, and at least one second relative spacing greater than the first spacing to permit substrate media exhibiting a greater than expected height above the first media transport. The printer control system can signal the actuator to set the gap in accordance with the trip wire sensor signals.

The printer may optionally include a media feeding unit for supplying substrate media to the printer, the media feeding unit having a plurality of selectable trays from which substrate media is selectably sourced. A precurl may apply a selectable degree of precurl to the substrate media.

The method optionally includes tacking the substrate media to the first media transport, as an illustrative example only by pressing the substrate media against the first media transport with a roller.

These and other purposes, goals and advantages of the present disclosure will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings, in which like reference numerals refer to like structures across the several views, and wherein.

DETAILED DESCRIPTION

Introduction

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper, transparencies, parchment, film, fabric, plastic, vellum, paperboard or other substrates on which an image can be printed or disposed.

As used herein "process path" refers to a path traversed by substrate media through a printer to be printed upon by the printer on one or both sides of the substrate media. Substrate media moving along the process path away from its beginning and towards its end will be said to be moving in the "process direction".

As used herein, "transport" when used as a noun, "media transport" or "transport apparatus", each and all refer to a mechanical device operative to convey a substrate media through a printer.

As used herein, a "trip wire sensor" refers to a tensioned wire or other body operatively connected to one or more transducers. Transducers, as used herein, are preferably based upon piezo-electric, micro-electromechanical system (MEMS), strain gauge, or similar technology capable of converting a mechanical force or displacement into an electric signal.

As used herein, "upcurl", is substrate media curvature towards the print head, in other words curl around a radius centered on the side of a cut sheet substrate media in the same direction as the print head.

As used herein, "downcurl" is curvature in the substrate media around a radius centered on the side of the cut sheet away from the print head.

As used herein, "print head array" refers to at least one print head or multiple print heads for printing or disposing images on substrate media.

As used herein, an "actuator" refers to a device operative to move at least one or both of the print head array and the first media transport so as to adjust the relative spacing between the print head array and the first media transport.

Description

Figure 1:
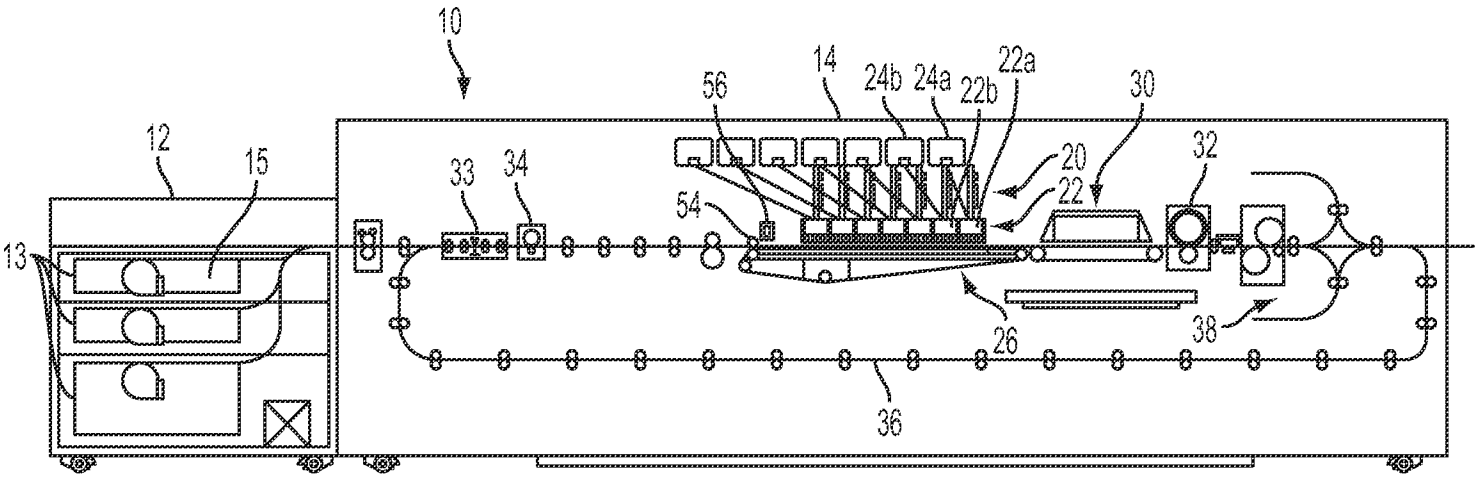
FIG. 1 illustrates schematically a printer with print head array for marking an image on substrate media.

Referring now to FIG. 1, illustrated is a printer, generally 10, according to a first embodiment of the present disclosure. The printer 10 may include a media feeding unit 12 in which one or more types of substrate media 15 may be stored and from which the substrate media 15 may be fed, for example sheet-by-sheet feeding of a cut sheet medium, to be marked with an image. The media feeding unit 12 delivers substrate media 15, for example from one or more media trays 13, to a marking unit 14 to be marked with a document image. The marking unit delivers marked substrate media 15 to an interface module (not shown) which may, for example, prepare the substrate for a finishing operation. Optionally the printer 10 may include a finishing unit (not shown), which receives printed documents from the interface module. The finishing unit, for example, finishes the documents by stacking, sorting, collating, stapling, hole-punching, or the like.

Marking unit 14 includes a marking zone, generally 20, within the marking unit 14. A marking zone 20 encompasses a marking engine, in this example an ink jet marking engine, having one or more print heads 22*a*, 22*b*, etc., collectively print head array 22, any of which are operative to directly mark the substrate media 15 and thereby form an image on the substrate media 15. Ink jet print head configuration is not the exclusive marking engine, and is offered as an example only. The ink jet print heads 22*a*, 22*b*, etc. may draw ink from respective reservoirs 24*a*, 24*b*, etc., or in some instances a collective reservoir (not shown). A marking zone transport 26 is operative to hold a substrate media 15 to itself securely, for example by electrostatic means or vacuum means, without limitation. In other embodiments, the marking engine may comprise any technology for printing, marking images or document creation in which a controlled gap must be maintained between the marking member and the surface of the substrate media 15.

The marking zone transport 26 is further operative to receive a substrate media 15 delivered towards the marking zone 20 and to convey the substrate media 15 towards, into, through, out of, and/or away from the marking zone 20, with positive control of the motion of the substrate media 15. The marking zone transport 26 maintains the substrate media 15 within the marking zone 20 in sufficient proximity to the print head array 22 to permit print heads 22*a*, 22*b*, etc. to mark the substrate media 15, but is designed and operated to avoid any contact between the substrate media 15 and the print head array 22. Contact between the substrate media 15 and the print head array 22 is to be avoided to negate the possibility of damage to the precise size and shape of the ink jet openings in the print head array, or to any coatings applied thereto, for example those which may facilitate precise ink particle/droplet formation. Such damage may be caused by impact or abrasion due to contact with the substrate media 15. Contact between the substrate media 15 and the print head array 22 may also be the cause of media jams leading to unscheduled stoppage of printing, wasting media and ink, requiring attention to service the error, and generally leading to customer dissatisfaction.

The marking zone transport 26 is configured and operative to pass the substrate media 15 to a downstream transport 30 for further handling. As example only, the downstream transport 30 includes a leveler transport, whose function is to bring all jetted ink to the same elevated temperature. The downstream transport 30 receives the substrate media 15 from the marking zone transport 26 and delivers the substrate media 15 to be subjected to a post-marking process 32, including without limitation ultra-violet light curing, fusing, spreading, drying, etc., any or some combination of which may be included without departing from the scope of the instant disclosure. In certain embodiments, the post-marking process includes a spreader nip 32, where the ink is spread under high pressure and elevated temperature to its final film thickness on the media. The post-marking process 32 may of course be omitted, if desired.

Included in the marking unit 14 are a curl sensor 33 and pre-curler unit 34, preferably upstream in the process path of the marking zone transport 26. The pre-curler unit 34 is operative to apply a selectable degree of pre-curl to the substrate media 15. In particular, a degree of curl in the substrate media 15 is detected by the curl sensor. The pre-curler unit 34 receives output from the curl sensor 33 in setting a desired degree of pre-curler. Also included in the marking unit 14 is a duplex path 36, operative to selectively return printed cut sheet documents to the print zone, for example to be imaged in duplex, i.e., on a reverse side thereof. A document inverter 38, operative to invert the orientation of the cut sheet substrate media 15 to facilitate printing on the reverse side thereof, may be located in the process path upstream of the diversion point for the duplex imaging path 36.

Figure 2:
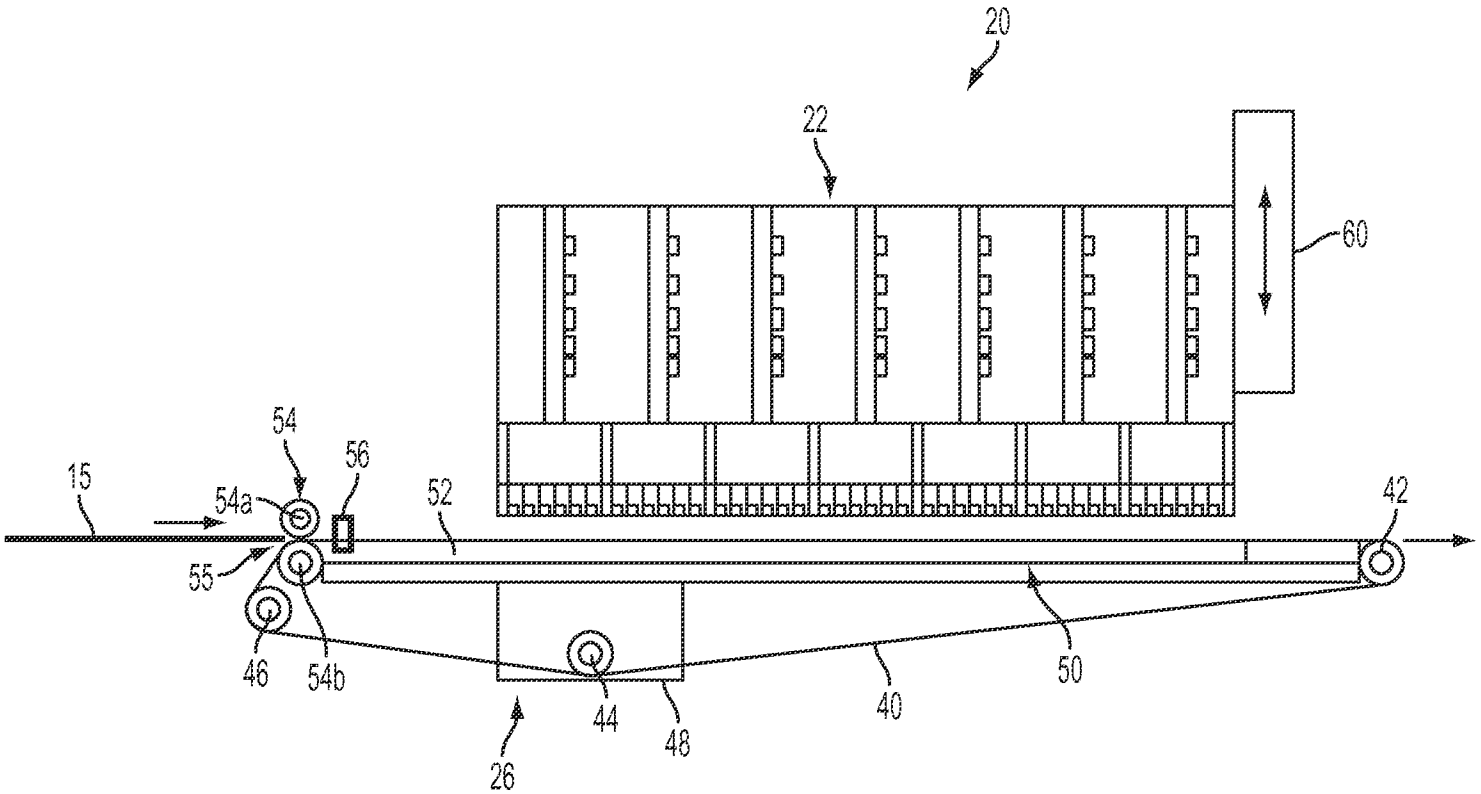
FIG. 2 illustrates schematically a print head array and marking zone transport.

Referring now to FIG. 2, illustrated schematically is a print head array 22 and marking zone transport 26 in closer detail. Marking zone transport 26 includes an endless belt 40 in a path around rollers including 42, 44, 46 and 54*b*. In this case, roller 42 serves as a drive roller, roller 44 a tensioning roller, roller 46 a steering roller, and roller 54*b* as an idler roller. Other configurations will be seen as within the scope of the present disclosure to one skilled in the art. A marking zone transport drive unit 48 controls the motion of the drive roller 42 by commanding a motor (not shown) operatively connected with the drive roller 42. The transport drive unit 48 can adjust the speed and/or direction of the first media transport.

Substrate media hold-down systems are operative in the marking zone 20 and provide means for drawing substrate media 15 toward the endless belt 40. Hold-down systems may comprise a vacuum powered hold-down system, an electrostatic hold-down system, or a combination of the two.

The endless belt 40 in certain embodiments is air-permeable, and platen 50 may include a vacuum hold-down manifold 52 positioned beneath the endless belt 40, including where the endless belt 40 passes beneath the print head array 22. As described, the endless belt 40 lies at least in part between the vacuum hold-down manifold 52 and the print head array 22. The vacuum hold-down manifold 52 introduces a negative atmospheric pressure at its top surface, which in turn draws air through the air-permeable endless belt 40. Substrate media 15 lying on the endless belt 40 is therefore drawn against endless belt 40 by the air flow which passes through the endless belt 40 and the vacuum hold-down manifold 52, and also by the air pressure differential between opposing sides of the substrate media 15 under the operation of the vacuum hold-down manifold 52. The vacuum hold-down manifold 52 is in fluid communication with a source of negative vacuum air pressure via a vacuum line (not shown). Flow through the vacuum line may be optionally controlled or varied, for example by provision of a flow control valve, pressure regulator, or the like. Alternately, the vacuum source may itself be configured to provide variable vacuum pressure.

Alternately, or in addition, to the vacuum hold-down means described above, the marking zone transport may be provided with an electrostatic hold-down means. In one embodiment, an electrostatic charge is applied onto the upper surface of sheet 15 while an opposite polarity electrostatic charge is deposited onto the lower surface of belt 40. The opposite charges are attracted to each other and a tack pressure is developed between sheet 15 and belt 40.

Further illustrated in FIG. 2 is a tacking nip 54, in this case a pair of tacking rolls 54*a*, 54*b* with one roll of the pair each above and beneath, respectively, the endless belt 40. In operation, substrate media 15 is delivered to the tacking roll 54 adjacent the endless belt 40. The tacking roll 54 presses the substrate media 15 towards the endless belt 40 in tacking zone 55, in order to initiate and/or assist the hold-down pressure applied by the marking zone transport 26 and to "tack" the substrate media 15 to the endless belt 40. Tacking rolls 54*a* and 54*b* may be electrically biased so as to apply the electrostatic charges to the substrate media 15 and/or the surface of the endless belt 40 as previously described The trip wire sensor assembly 56 is operatively associated with the marking zone transport 26 and the printer control system (not shown). The printer control system is operatively connected to the actuator 60.

The marking zone transport 26 and/or the print head array 22 may each be mounted by, on or to a frame or chassis portion of the marking unit 14. Furthermore, the print head array 22 may be mounted in order to permit it to adjust position with respect to the marking zone transport 26. The adjustment can be controlled, for example, by an actuator 60. The gap between a print head array 22 and the substrate media 15 is preferably variable between at least a nominal operating gap at which printing may occur and a second greater gap for a passing non-conforming substrate media 15 through the marking zone 20 without damaging the print head array 22.

Actuator 60 may be driven electrically, or by fluid power, and may be linear and/or vertical, as in the embodiment shown, or also rotary in nature (rack-and-pinion, rotary levers, etc.). The actuator 60 may also include an encoder (not shown) to provide feedback concerning the position of the print head array 22. Alternately or additionally the marking zone transport, and/or at least the platen portion thereof that underlies the print head array, may be mounted for adjustable motion with respect to the print head array. Here again, the actuation may be driven by a variety of motive power sources, and/or in either a linear or rotary fashion, and optionally be associated with some form or positional feedback indication, e.g., an encoder.

Figure 3:
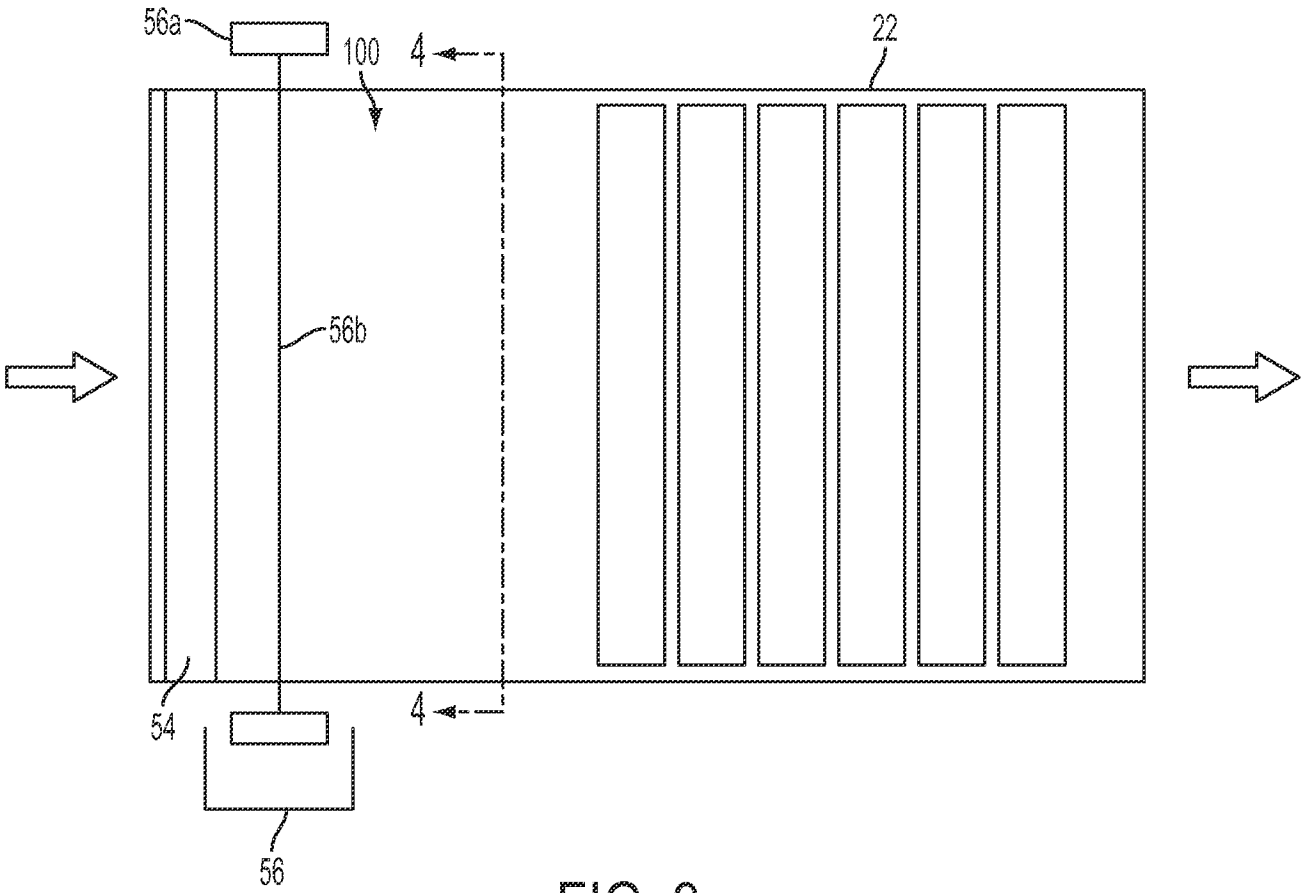
FIG. 3 illustrates the plan view schematic of the substrate media marking zone transport of the printer.

FIG. 3 illustrates a plan view schematic of the marking zone transport. Sheets 15 enter from the left and are acquired onto the marking zone transport belt at the tacking nip 54. Each sheet then passes by the trip wire sensor assembly 56, the reaction zone 100, and then the print head array 22 at which point the print heads mark the substrate with an image.

Figure 4:
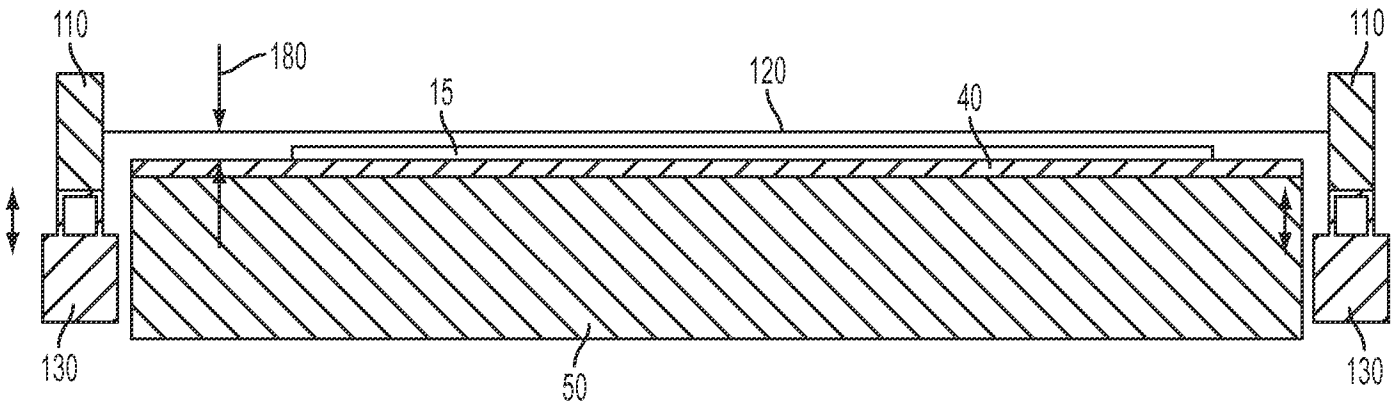
FIG. 4 illustrates a partial sectional view of the substrate media marking zone transport of the printer through section line 4 of FIG. 3.

FIG. 4 illustrates a sectional view of the marking zone transport through section line 4 of FIG. 3, where the tacking roll has been removed for clarity. The trip wire sensor assembly 56 comprises two transducers 110 with a tensioned line, the trip wire 120 spanning between them. Transducers 110 are preferably based upon piezo-electric, micro-electromechanical system (MEMS), strain gauge, or similar technology capable of converting a mechanical force or displacement into an electric signal. Each transducer 110 may be mounted adjustably 130 so that the height of the tensioned line, the trip wire 56 above the transport belt 40, that is, the sensing gap 180 can be varied as a function of expected media 15 thickness. The height adjustment mechanism 130 could be via cam or fine pitch screw. In general, the sensing gap 180 will be kept equal or less than the print head-to-transport belt gap, which may also be adjustable based on expected substrate media 15 thickness.

One embodiment of a trip wire sensor assembly was separately tested using two standard piezo-electric buzzers as the transducers. Each consists of a plastic housing supporting a thin metal disk to which a thin piezo ceramic disk is bonded. Each disk assembly has a through hole to which one end of a tensioned line is anchored. Any significant deflection of the line thus causes a tension wave to propagate along the line to each disk. Two different line materials were tested: thirty-one gauge copper wire and twelve pound test fiberglass fishing line. Three different electrical configurations were tested.

Figure 5:
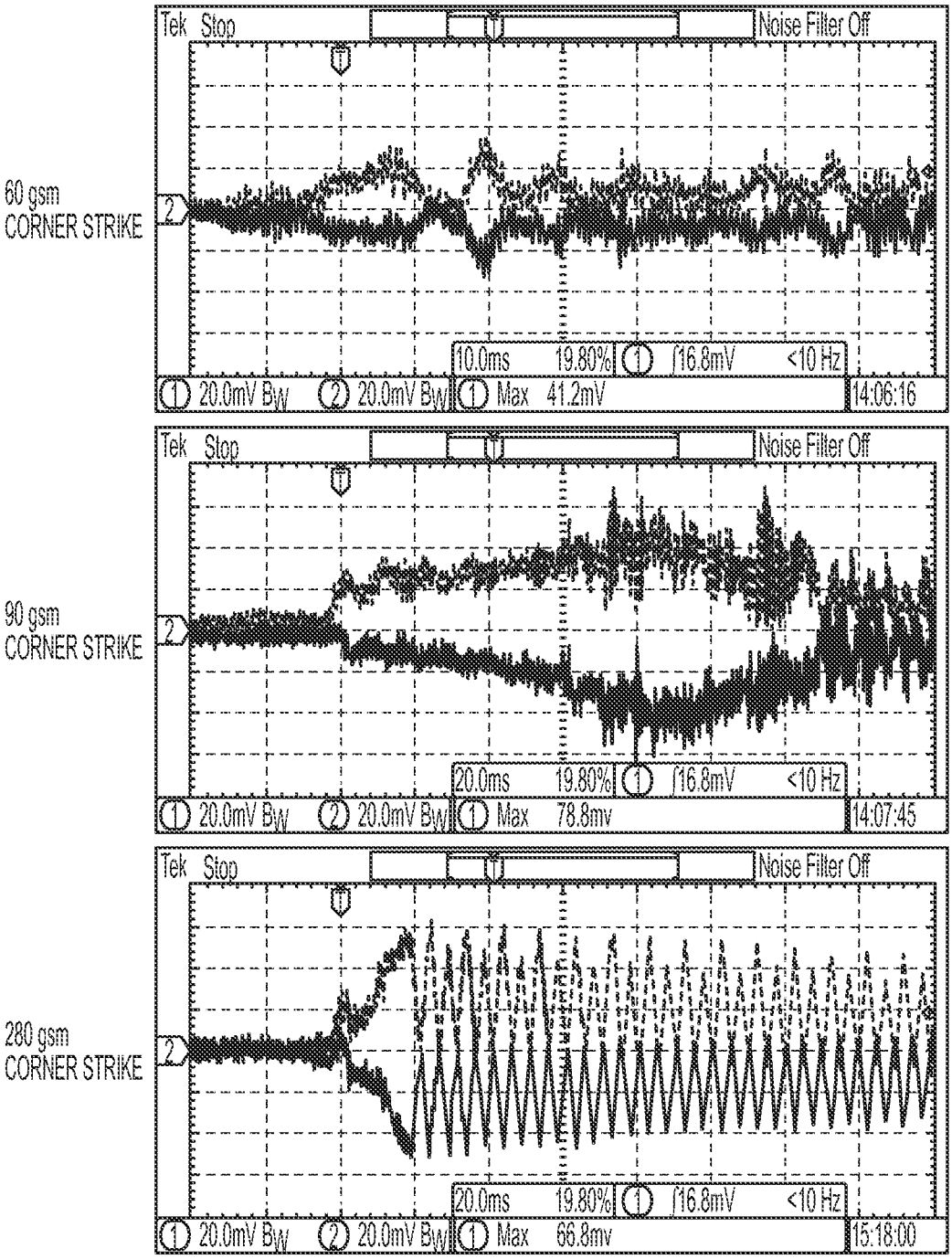
FIG. 5 illustrates the transducer output of one embodiment using copper wire for the trip wire.
Figure 6:
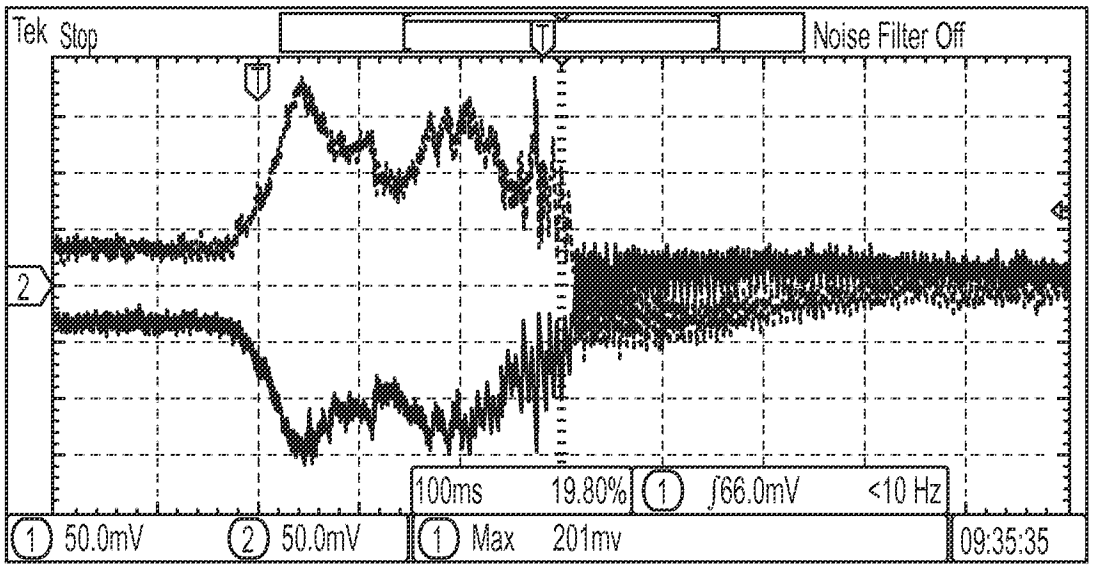
FIG. 6 illustrates the transducer output using of one embodiment using fiberglass line for the trip wire.

In the simplest ("Dual Passive") mode, each transducer output was simply monitored for amplitude changes using an oscilloscope. FIG. 5 shows the resulting transducer output for three different sheet corner 'strike' levels using the copper wire. Given the mirror symmetry of the mounted disk assemblies, it is evident that a differential signal can be extracted in this mode, which will provide some common mode noise immunity. FIG. 6 shows a typical transducer response when using the fiberglass line.

Two other electrical modes were also tested and the results provided support for their use: "Single Active" mode drives one transducer with a carrier frequency supplied by a signal generator and the output of the passive transducer is measured for amplitude changes; "Closed Loop" mode feeds back the output of the passive transducer to the base of a transistor that drives the active transducer, and excursions in the resonant frequency are then monitored.

It is expected that the trip wire sensor assembly 56 could normally operate in Dual Passive mode but could periodically do a Single Active mode self-check, for example, to ensure the trip wire line 120 is intact and tensioned. It is also expected that the entire trip wire sensor assembly 56 could be spring loaded in place so that any significant force from a substrate media 15 collision can be limited well below the line's breaking strength. This action also limits the contact force acting on the substrate media 15 to prevent a lifted substrate media sheet corner from stubbing and jamming on the line.

Generally the trip wire sensor assembly will produce an analog signal output where the output signal will be approximately proportional to the strike force. Thus, it is possible that a thin substrate media sheet 15 could 'brush' the trip wire line 120 and the resulting signal could fall within the normal noise range. However, the implication of a gentle brush also implies that any contact force of the sheet with the print heads will also be gentle and thus of less concern for potential print head damage.

Figure 7:
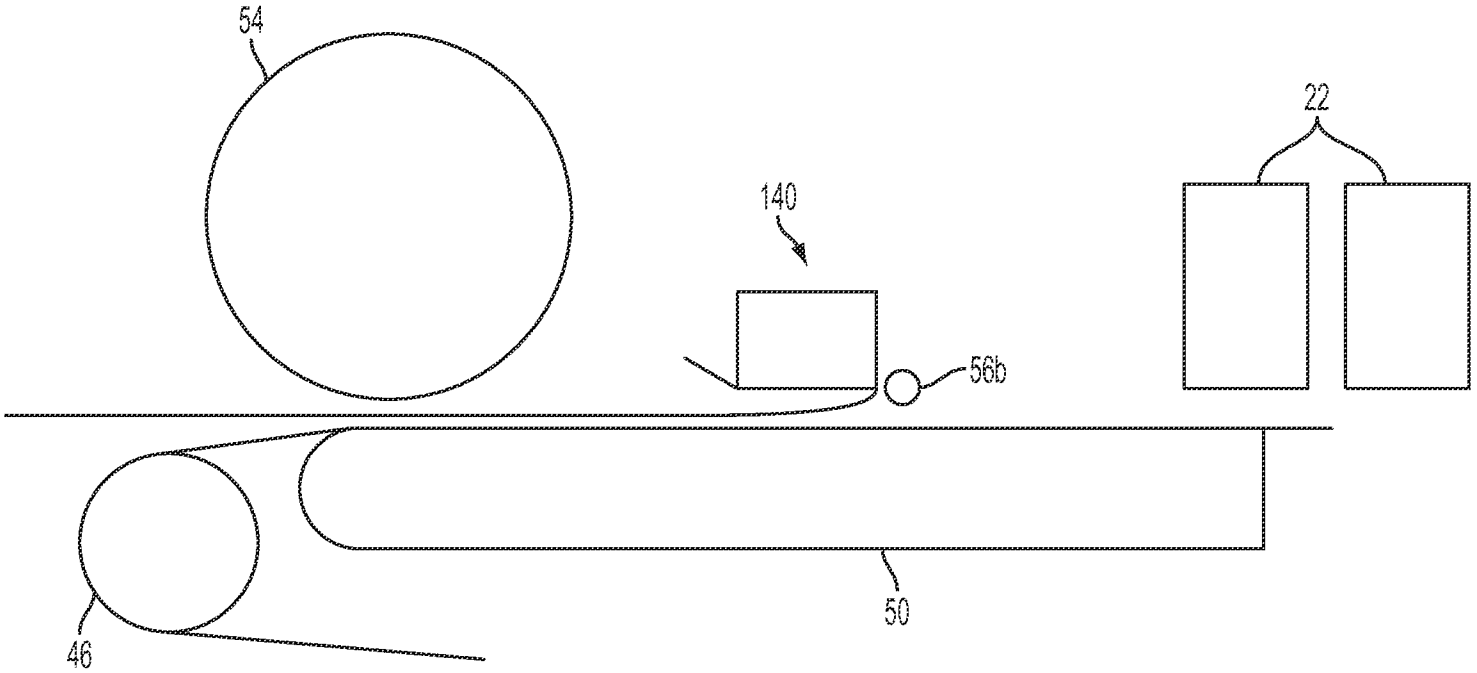
FIG. 7 illustrates schematically an embodiment of a trip wire protective guide.
Figure 8:
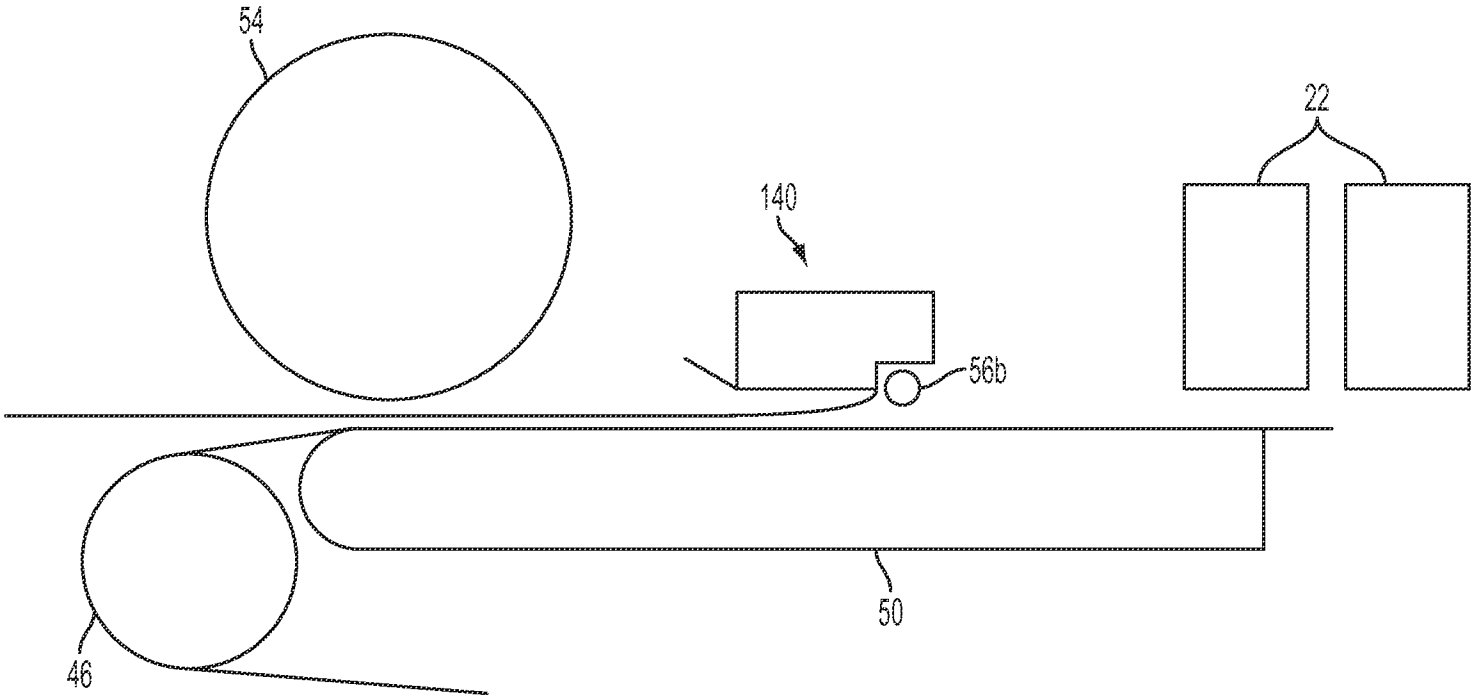
FIG. 8 illustrates schematically another embodiment of a trip wire protective guide.

FIGS. 7 and 8 show schematic embodiments of a protective guide 140 which can be placed at least partially upstream of the sensor. The protective guide is expected to be much stiffer than either the tensioned line 120 or the substrate media 15. The lower surface of the protective guide 140 is generally positioned flush or slightly above the bottom of the tensioned line 120 along the vertical axis and is placed close to the tensioned line along the horizontal axis as shown by example in FIGS. 7 and 8. This arrangement should eliminate or at least minimize the possibility, for example, that a sheet corner or other LE defect will go over the top of the tensioned line, which could result in a paper jam. Instead, the LE defect, for example, will generally be constrained in height by the protective guide 140 and will contact the underside of the tensioned wire 120.

Figure 9:
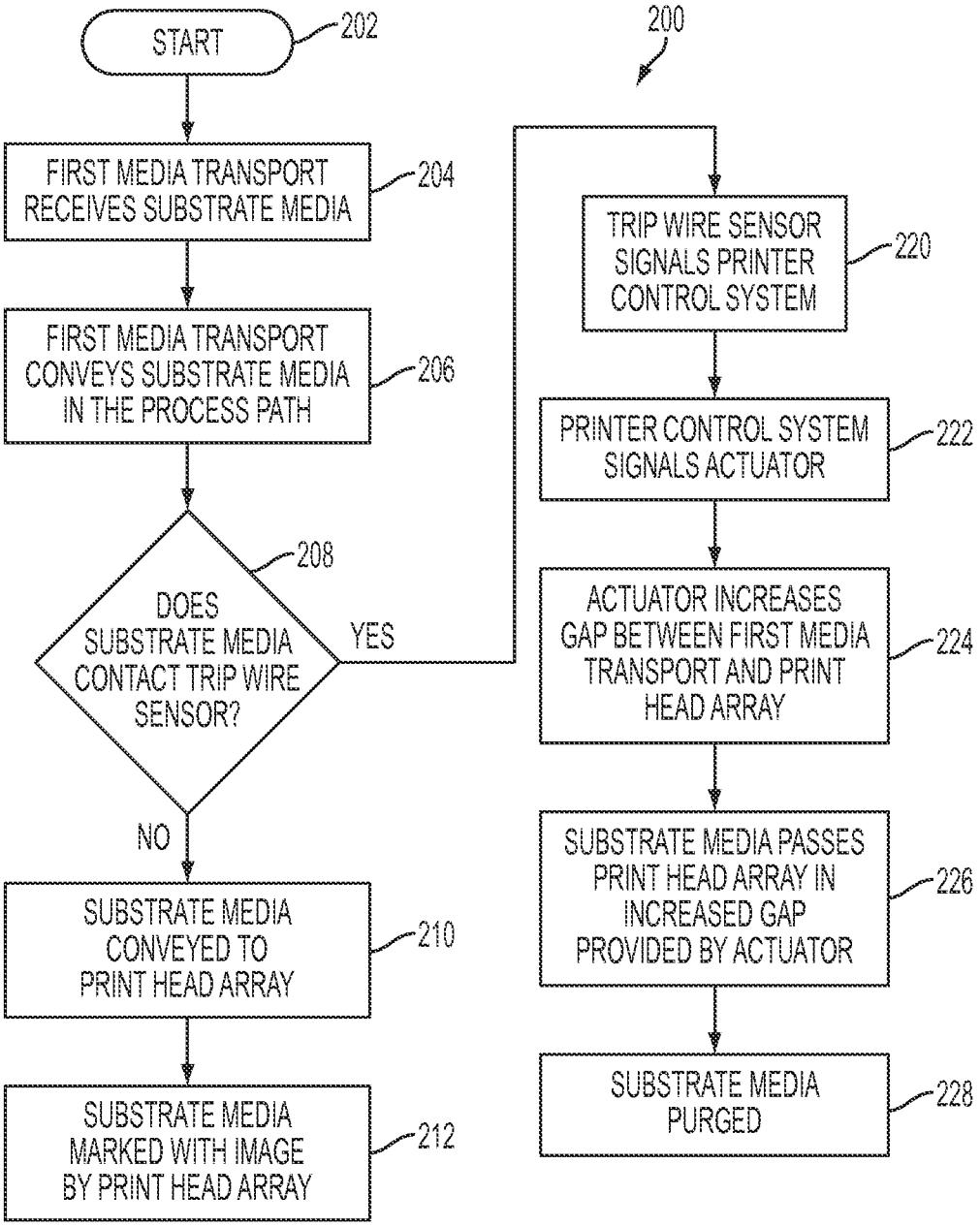
FIG. 9 depicts a flowchart showing an exemplary mode of operation according to the present disclosure.

The flowchart 200 in FIG. 9 depicts an exemplary mode of operation according to an embodiment of the present disclosure. Beginning from a start condition 202, the first media transport receives substrate media 204 and conveys the substrate media in the process path 206 for marking with an image. The trip wire sensor then determines whether or not it has been contacted by substrate media 208. If the substrate media does not contact the trip wire sensor, the substrate media continues to the print head array 210 where it is marked with an image 212. If the substrate media contacts the trip wire sensor, the trip wire sensor signals the printer control system 220 and the printer control system signals the actuator 222. In response to the printer control system's signal, the actuator increases the gap between the first media transport and print head array 224. Next, the substrate media is conveyed by the first transport media past the print head array in the increased gap provided by the actuator 226. Finally, the substrate media may be purged 228.

In another embodiment of the present disclosure, the substrate media contacts the trip wire sensor, the trip wire sensor signals the printer control system 220 and the printer control system signals the actuator 222 and the transport drive unit 48. In response to the printer control system's signal, the actuator increases the gap between the first media transport and print head array 224, and the transport drive unit 48 may cause the first media transport to slow its speed in order to increase the available time for increasing the gap. Next, the substrate media is conveyed by the first media transport past the print head array in the increased gap provided by the actuator 226. Finally, the substrate media may be purged 228. Alternative system responses also include the transport drive unit 48 stopping and reversing the travel direction of the first media transport in order to re-route contacting substrate media back to an upstream purge or other location.

Variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A printer comprising:

at least one print head;

at least one media transport operative to receive a substrate media and to convey the substrate media past said at least one print head;

a trip wire sensor upstream of the at least one print head, said trip wire sensor including a tensioned wire operatively connected to at least one transducer, said trip wire sensor operative to detect if a part of the substrate media conveyed by said at least one media transport exceeds a predetermined height above the at least one media transport, said tensioned wire being positioned to be contacted by the substrate media if the substrate media exceeds the predetermined height, and generate a first signal that the substrate media exceeds the predetermined height; and a printer control system which upon receipt of the first signal takes corrective action to prevent substrate media from contact with the print head, wherein contact by the substrate media with said tensioned wire causes the at least one transducer to generate the first signal to the printer control system.

2. The printer according to claim 1, wherein the corrective action comprises the printer control system sending a second signal to a transport drive unit to adjust the speed and/or direction of the at least one media transport.

3. The printer according to claim 2, wherein the corrective action further comprises the printer control system sending a third signal to an actuator operative, upon receipt of the third signal, to adjust the relative spacing between the at least one print head and the at least one media transport to greater than the predetermined height.

4. The printer according to claim 1, wherein the corrective action comprises the printer control system sending a third signal to an actuator operative, upon receipt of the third signal, to adjust the relative spacing between the at least one print head and the at least one media transport to greater than the predetermined height.

5. The printer according to claim 1, further comprising:

a hold-down system operative to generate a hold-down pressure applied to the substrate media in the direction of the at least one media transport; and a precurler unit operative to apply a predetermined degree of curl to the substrate media.

6. The printer according to claim 5, wherein the hold-down system comprises one of a vacuum powered hold-down system or an electrostatic hold-down system.

7. The printer according to claim 5, wherein the hold-down system comprises a vacuum powered hold-down system and an electrostatic hold-down system.

8. The printer according to claim 1, further comprising a trip wire sensor protective guide which directs substrate media contacting the trip wire sensor protective guide toward the side of the trip wire sensor protective guide facing the at least one media transport.

9. The printer according to claim 8, wherein the protective guide, a portion of which is positioned upstream of the trip wire sensor, comprises a lower surface which is positioned flush or slightly above the bottom of the trip wire sensor.

10. The printer according to claim 1, wherein the tensioned wire is comprised of fiberglass line or copper wire.

11. The printer according to claim 1, further comprising:

a duplex path configured to enable duplex printing on the substrate media; and a diverter operative to divert substrate media from a process path to the duplex path.

12. A method of printing utilizing at least one print head in a printer, said method comprising:

conveying substrate media on at least one media transport past said at least one print head;

determining with a trip wire sensor, while the substrate media is being conveyed prior to said at least one print head, if the substrate media exceeds a predetermined height; and taking corrective action to prevent the substrate media from contact with the print head, if it is determined that the substrate media exceeds the predetermined height, wherein the trip wire sensor comprises a tensioned wire operatively connected to at least one transducer, said tensioned wire being positioned to be contacted by the substrate media if the substrate media exceeds the predetermined height, contact by the substrate media with said tensioned wire causes the at least one transducer to generate a first signal to a printer control system to cause the corrective action.

13. The method according to claim 12, further comprising:

the at least one media transport including a hold-down system operative to generate a hold-down pressure applied to the substrate media in the direction of the at least one media transport, the substrate media having a predetermined degree of downcurl applied thereto; and wherein the substrate media is conveyed into, through, or out of a marking zone of the printer under the influence of the hold-down pressure.

14. The method according to claim 12, wherein the corrective action comprises the printer control system sending a second signal to a transport drive unit to adjust the speed and/or direction of the at least one media transport.

15. The method according to claim 14, wherein the corrective action further comprises the printer control system sending a third signal to an actuator to adjust the gap between said at least one print head and the at least one media transport.

16. The method according to claim 12, wherein the corrective action comprises the printer control system sending a third signal to an actuator to adjust the gap between said at least one print head and the at least one media transport.

17. The method according to claim 12, wherein the tensioned wire is comprised of fiberglass line or copper wire.

18. The method according to claim 12, wherein the trip wire sensor is provided with a trip wire sensor protective guide which directs substrate media contacting the trip wire sensor protective guide toward a side of the trip wire sensor protective guide facing the at least one media transport.

19. The method according to claim 18, wherein the protective guide, a portion of which is positioned upstream of the trip wire sensor, comprises a lower surface which is positioned flush or slightly above the bottom of the trip wire sensor.

20. The method according to claim 12 wherein the printer includes a diverter operative to divert substrate media from a process path to a duplex path.

21. The method according to claim 20 wherein the diverter diverts substrate media detected at the predetermined height from the process path to the duplex path.

22. The method according to claim 12 wherein the corrective action comprises purging the substrate media detected at the predetermined height.

23. The method according to claim 12, further comprising tacking the substrate media to the at least one media transport.

* * * * *